US008063854B2

(12) United States Patent
Le Roy et al.

(10) Patent No.: US 8,063,854 B2
(45) Date of Patent: Nov. 22, 2011

(54) VIDEO DISPLAY DEVICE AND OPERATING METHOD THEREFORE

(75) Inventors: Philippe Le Roy, Betton (FR); Pierrick Martin, Rennes (FR); Dominique Gagnot, Charavines (FR)

(73) Assignee: Thomson Licensing, Boulogne-Billancourt (FR)

( * ) Notice: Subject to any disclaimer, the term of this patent is extended or adjusted under 35 U.S.C. 154(b) by 977 days.

(21) Appl. No.: 11/805,028

(22) Filed: May 22, 2007

(65) Prior Publication Data

US 2007/0296717 A1 Dec. 27, 2007

(30) Foreign Application Priority Data

Jun. 1, 2006 (EP) ..... 06300542

(51) Int. Cl.
*G09G 3/30* (2006.01)

(52) U.S. Cl. ..... 345/76; 345/214; 315/169.3

(58) Field of Classification Search ..... 345/214, 345/76; 315/169.3
See application file for complete search history.

(56) References Cited

U.S. PATENT DOCUMENTS

| | | | | |
|---|---|---|---|---|
| 6,452,576 | B1 | 9/2002 | Van Velzen et al. | |
| 7,262,749 | B2 * | 8/2007 | Koyama et al. | 345/76 |
| 2003/0030603 | A1 * | 2/2003 | Shimoda | 345/76 |
| 2004/0100430 | A1 | 5/2004 | Fruehauf | |
| 2004/0164949 | A1 | 8/2004 | Koyama et al. | |
| 2006/0139264 | A1 * | 6/2006 | Choi et al. | 345/76 |
| 2006/0261863 | A1 * | 11/2006 | Furuichi | 327/108 |
| 2007/0241820 | A1 * | 10/2007 | Hashimoto et al. | 330/260 |

FOREIGN PATENT DOCUMENTS

| | | |
|---|---|---|
| EP | 1622120 | 2/2006 |
| WO | WO 2005/071649 | 8/2005 |
| WO | WO 2005/073948 | 8/2005 |

OTHER PUBLICATIONS

European Search Report Sep. 26, 2006.

* cited by examiner

*Primary Examiner* — Richard Hjerpe
*Assistant Examiner* — Dorothy Harris
(74) *Attorney, Agent, or Firm* — Robert D. Shedd; Jeffrey M. Navon

(57) ABSTRACT

A video display device comprises a plurality of light emitting elements arranged in a matrix having rows and columns; a plurality of first current modulators each of which is associated to one of said light emitting elements for drawing a feed current of programmable intensity for the associated light emitting element from a circuit node associated to each of said columns; a current generator controlled by video data representative of desired luminosities of said light emitting elements for supplying a first current ($I_{DATA}$)to said circuit node, the intensity of which is representative of a desired luminosity of at least one of said light emitting elements; the circuit node having a specific voltage level when the intensity supplied by said current generator is drawn from the current node by the first current modulator associated to said at least one light emitting element; a second current modulator for supplying a second current ($I_{10}$) to said circuit node; a comparator having inputs connected to said circuit node and to a reference terminal which is constantly held at said specific voltage level and an output connected to a control input of said second current modulator, whereby the second current ($I_{10}$) from said second current modulator is controlled so as to yield said specific voltage level at the circuit node.

7 Claims, 2 Drawing Sheets

VIDEO DISPLAY DEVICE AND OPERATING METHOD THEREFORE

This application claims the benefit, under 35 U.S.C. §119 of European Patent Application 06300542.5, filed Jun. 1, 2006.

The present invention relates to a video display device comprising a plurality of light-emitting elements arranged in a matrix having lines and columns, and to a method for operating such a display device.

Display devices of this type require driver circuits for controlling the luminosity of each of its light-emitting elements. In passive matrix technology, one driver circuit is associated to a plurality of light-emitting elements and supplies these with operating current pulses according to a time division scheme, i.e. at a given instant, only one of the light-emitting elements associated to a given driver circuit receives from it an operating current and emits light, whereas the others receive no current and remain dark. Passive matrix technology involves simple and inexpensive circuitry, but in order to achieve a reasonable overall luminosity of the display device, the intensity of the pulses supplied to the individual light-emitting elements must be high, causing problems such as premature aging of the light-emitting elements and a low reliability of the display device.

In active matrix technology, each light-emitting element has a current modulator associated to it, which is programmable to supply its light-emitting element with a continuous operating current, the intensity of which is updated when a new image is to be displayed.

EP 1 622 120 A1 discloses a display device of this type. Each of the light-emitting elements of this display device has a first current modulator associated to it, for drawing a feed current of programmable intensity for the associated light-emitting element from a circuit node associated to each of the matrix columns. Further, each column has a current generator associated to it, which is controlled by video data representative of desired luminosities of the light-emitting elements of said column for supplying a first current to said circuit node, the intensity of which is representative of a total desired luminosity of all light-emitting elements of said column. I. e. the first current from the current generator is distributed and supplied to the light-emitting elements of the column in proportion to their intended luminosities as defined by the video data received by the current source.

When displaying a variable image such as a TV image, the luminosities of the light emitting elements must be updated continuously, element by element. Putting things simply, one might say that the luminosity of one element is updated by having the current generator outputting to said circuit node a first current proportional to the sum of the updated luminosity of said one element and the present luminosities of the other elements, and by programming the first current modulator associated to the element to be updated so that it will absorb from the circuit node that portion of the first current which is not absorbed by the first current modulators of all the other elements. It is readily apparent that for such a scheme to work, the current source must be able to control the first current intensity at a resolution of n*m, if n is the number of light-emitting elements in a column and m is the number of luminosity levels which these elements shall be able to display. In a practical embodiment, in which n has a value of approximately 1000 typical for a TV image and m is e.g. 256, the required resolution is approximately 256,000. Such a resolution requires sophisticated and expensive circuitry for the current source.

The object of the present invention is to provide a video display device in which the required resolution of the voltage source is considerably reduced, so that simple and inexpensive circuitry may be used.

This object is achieved by a video display device comprising a plurality of light-emitting elements arranged in a matrix having lines and columns; a plurality of first current modulators, each of which is associated to one of said light-emitting elements, for drawing a feed current of programmable intensity for the associated light-emitting element from a circuit node associated to each of said columns; a current generator controlled by video data representative of desired luminosities of said light-emitting elements for supplying a first current to said circuit node, the intensity of which is representative of a desired luminosity of at least one of said light-emitting elements; the circuit node having a specific voltage level when the intensity supplied by said current generator is drawn from the current node by the first current modulator associated to said at least one light-emitting element, the display device being characterized by a second current modulator for supplying a second current to said circuit node, and a comparator having inputs connected to said circuit node and to a reference terminal which is constantly held at said specific voltage level and an output connected to a control input of said second current modulator, whereby the second current from said second current modulator is controlled so as to yield said specific voltage level at the circuit node.

After programming said at least one light-emitting element using the first current from said current generator, the current generator may be switched off, causing the voltage at the circuit node to temporarily deviate from said specific voltage level. The comparator then controls the second current modulator such that the specific voltage level is re-established, whereby the first current previously output by the current source is replaced by current of the same intensity from the second modulator. The current generator is then available again to supply a first current representative of a desired luminosity of at least another one of said light-emitting elements.

Preferably the intensity of the first current from the current generator at a given instant is representative of the desired luminosity of just one light-emitting element. In that case, the required resolution of the current generator reduces to the number m of luminosity levels.

The comparator of the display device preferably has its output connected to the control input of the second current modulator by a switch, and a storage capacitor is connected to the control input for maintaining it at a constant voltage when said switch is open, so that the second current supplied to the circuit node by said second current modulator will be constant whenever the switch is open.

The comparator preferably is an operational amplifier having an inverting input connected to said circuit node and a non-inverting input connected to said reference terminal.

Further, a second comparator having inputs connected to said circuit node and to said reference terminal, and a plurality of switches for selectively connecting an output of said second comparator to a control input of one of said first current modulators may be provided.

A method for operating a display device comprising a plurality of light-emitting elements arranged in a matrix having lines and columns; a plurality of first current modulators, each of which is associated to one of said light-emitting elements, for drawing a feed current of programmable intensity for the associated light-emitting element from a circuit node associated to each of said column; a current generator controlled by video data representative of desired luminosity of said light-emitting elements; and a second current modulator for supplying a second current to said circuit node comprises the steps of a) supplying a first current representative of a desired luminosity of at least the first one of said light-emitting elements to said circuit node from said current generator;

b) programming the first current modulator associated to said at least one of said light-emitting elements to draw said first current from said circuit node, whereby the circuit node attains a specific voltage level;

c) ceasing to supply said first current from said voltage generator;

d) controlling the intensity of said second current so as to re-establish said specific voltage level at said current node.

This method is preferably repeated for at least a second one of said light-emitting elements. In that case, while repeating steps a) and b) the intensity of the second current is preferably held at the value set in previous step d). In that case, when step d) has been repeated, the first current modulators of the first and second light-emitting elements will both receive from the circuit node a current of appropriate intensity for their desired luminosity, so that the method can be repeated for a third one of the light-emitting elements, and so on, until all light-emitting elements of the column operate at their respective desired intensities.

When displaying variable images such as TV images, steps a) to d) will also have to be repeated for said at least one of said light-emitting elements. Before doing so, the first current modulator associated to said at least one of said light-emitting elements should preferably be programmed not to draw current from said circuit node, in order to avoid an undesirable drift of its luminosity.

The invention will be more easily understood and further features and advantages will become apparent from the subsequent description of embodiments thereof referring to the appended drawings.

Figure 1:
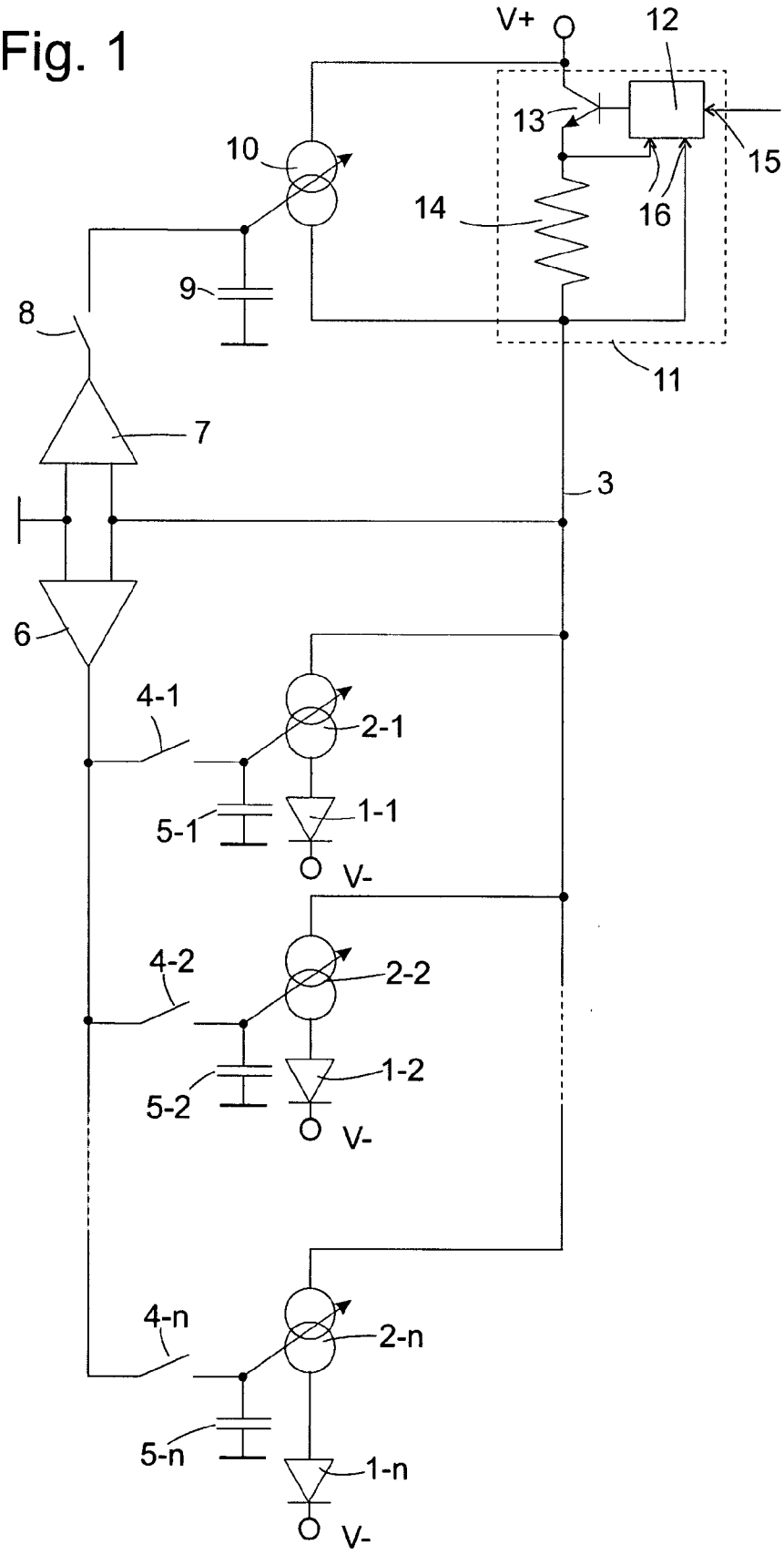
FIG. 1 is a schematic circuit diagram of an exemplary portion of the display device according to an embodiment of the invention.

The display device of the invention comprises a large number n*l of light-emitting elements such as OLEDs (Organic Light-Emitting Diodes) arranged on a substrate in a matrix of n lines and l columns. Since the columns are identical in design and operation, FIG. 1 illustrates just one of these columns. The column comprises OLEDs 1-1, 1-2, . . . , 1-n serially connected to an associated current modulator 2-1, 2-2, . . . , 2-n. The OLEDs and the current modulators are connected in parallel between a circuit node 3 and a negative supply potential V−.

The current modulators 2-1, 2-2, . . . , 2-n may each be formed by a FET having two current electrodes, one connected to the circuit node 3 and the other to the OLED 1-1, 1-2, . . . or 1-n, respectively, and a control electrode connected to first sides of a switch 4-1, 4-2, . . . , 4-n and of a storage capacitor 5-1, 5-2, . . . , 5-n. Incidentally, the storage capacitors have their second sides connected to ground, but they might as well be connected to said negative supply voltage V−, to a positive supply voltage V+ or to any other appropriate constant potential. The switches 4-1, 4-2, 4-n have their second sides connected to an output of an operational amplifier 6, of which a non-inverting input is connected to circuit node 3 and an inverting input is connected to ground.

An operational amplifier 7 has its non-inverting input connected to ground, its inverting input connected to circuit node 3 and its output connected to a first side of a switch 8, a second side of which is connected to a storage capacitor 9 and to a control terminal of a current modulator 10 which may be of the same type as current modulators 2-1, 2-2, . . . , 2-n. Current modulator 10 has its current terminals connected to positive supply voltage V+ and to circuit node 3.

An exemplary current generator 11 comprises a control block 12, a transistor 13 and a resistor 14. Transistor 13 and resistor 14 are connected in series between the positive supply voltage V+ and the circuit node 3. Control block 12 has an input 15 for receiving digital data representative of desired luminosities of OLEDs 1-1, 1-2, . . . , 1-n, inputs 16 for detecting a voltage drop across resistor 14 and an output connected to a control electrode of transistor 13. Transistor 13 may be a bipolar or MOS-FET transistor.

Figure 2:
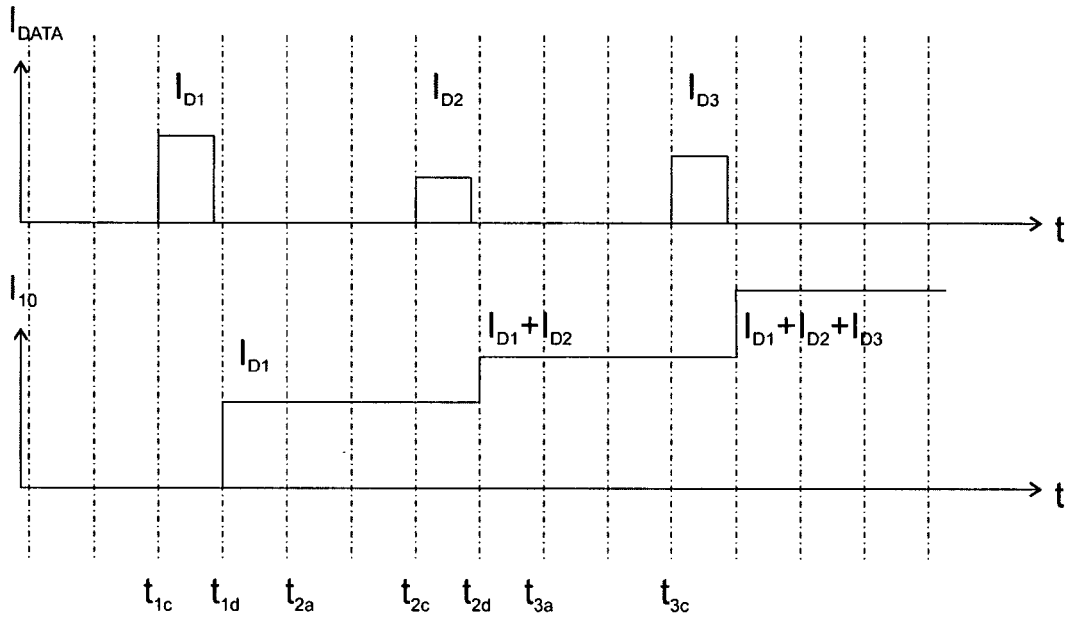
FIG. 2 is a waveform diagram illustrating currents in the display device of FIG. 1 during the build-up of a first display image.
Figure 3:
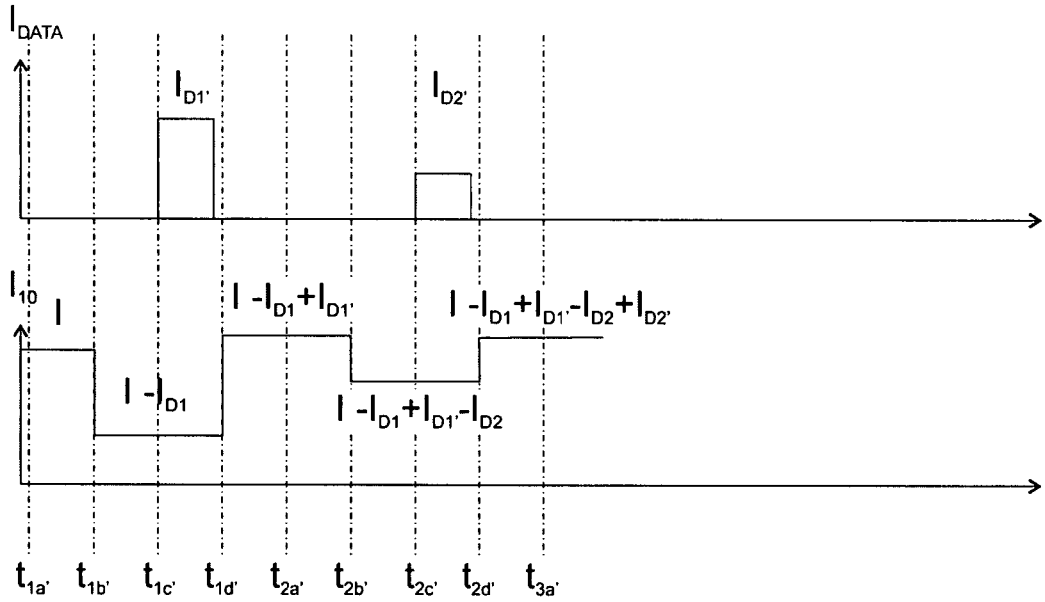
FIG. 3 is a waveform diagram illustrating currents during the build-up of a subsequent image.

For explaining the operation of the circuitry of FIG. 1, let us assume that the display device is just starting operation, and that initially all current modulators 2-1, 2-2, . . . , 2-n, 10 and the current generator 11 are in a blocking state, so that all OLEDs are dark. Further, for the sake of convenience, it will be assumed that the first digital luminosity value received at input 15 is a value D1 corresponding to OLED 1-1. Reference is made to FIGS. 2 and 3, which illustrate waveforms of output currents $I_{DATA}$ Of current generator 11 and $I_{10}$ of current modulator 10.

The control block reacts to the luminosity value $D_1$ being input by closing switch 4-1 and making transistor 13 conductive, so that at a time $t_{1c}$ (cf. FIG. 2) a positive current $I_{DATA}$ begins to flow from current generator 11 to circuit node 3. The potential of circuit node 3 thus becomes positive. This causes operational amplifier 6 to output a positive voltage which charges storage capacitor 5-1 and causes current modulator 2-1 to become conductive, enabling a continuous flow of current through resistor 14 and circuit node 3. The control block 12 continuously adapts the voltage applied by it to the control electrode of transistor 13 until the voltage drop detected at inputs 16 is in a predetermined relation to the input luminosity value D1, indicating that a current $I_{DATA}=I_{D1}=c*D1$ having the necessary intensity for generating the desired luminosity D1 is flowing from current generator 11 through current modulator 2-1 and OLED 1-1.

When this happens, it is likely that the circuit node 3 will at first have a positive potential. This positive potential causes operational amplifier 6 to output a current which continues to charge storage capacitor 5-1, thus gradually increasing the potential at the control electrode of current modulator 2-1 and increasing its conductivity. Control block 12 continuously adjusts the control voltage applied to transistor 13, so that the current through circuit node 3 is kept constant at $I_{D1}$. Soon, a steady state is reached in which circuit node 3 has ground potential. In this state, control block 12 reopens switch 4-1.

In a next step, at a time $t_{1d}$, control block 12 blocks transistor 13, so that current generator 11 becomes non-conductive ($I_{DATA}=0$), and closes switch 8. Since current modulator 2-1 stays conductive, the potential of circuit node 3 decreases, which causes operational amplifier 7 to output a positive current to storage capacitor 9 and to the control electrode of current modulator 10. Again, a steady state is reached as soon as circuit node 3 has returned to ground potential. When this happens, the current through OLED 1-1 is exactly equal to $I_{D1}$, but the current is supplied not by current generator 11 any more, but by current modulator 10.

In a subsequent step, from time $t_{2a}$ to $t_{2c}$, the control block 12 carries out a reset procedure which, for better understanding, will be explained later on.

By the time $t_{2c}$, the control block 12 has received a second digital data specifying a desired luminosity D2 of OLED 1-2. At $t_{2c}$, it closes switch 4-2 and begins to control transistor 13 so as to have a current $I_{DATA}=I_{D2}$ corresponding to said desired luminosity D2 flowing through current generator 11. Again, the potential of circuit node 3 becomes slightly positive, this time causing amplifier 6 to charge capacitor 5-2, and to make current modulator 2-2 conductive. A steady state is reached in which circuit node 3 is at ground potential, and the current $I_{DATA}=I_{D2}$ from current generator 11 is absorbed by OLED 1-2, whereas the current $I_{10}$ from current modulator 10 flows through OLED 1-1. Control block 12 then opens switch 4-2, and at the time $t_{2d}$, it blocks transistor 13 and closes switch 8 again. A potential decrease at circuit node 3 causes amplifier 7 to continue to charge capacitor 9, until the current $I_{10}$ through current modulator 10 becomes equal to $I_{D1}+I_{D2}$.

The procedure is repeated for all remaining OLEDs of the column, and at the end of each repetition, the current from current modulator 10 is increased by the desired intensity $I_{Di}$, i=3, . . . , n, for each of the OLEDs, finally reaching $I_{\Sigma}=I_{D1}+I_{D2}+\ldots+I_{Dn}$. At this stage, an entire image is visible on the display device.

The next digital data received by control block 12 is data specifying a desired luminosity D1' of OLED 1-1 in a subsequent picture. In order to adapt the luminosity of OLED 1-1 to this new value, at a time $t_{1a'}$ (see FIG. 3), control block 12 begins a reset procedure by closing switch 4-1, whereby storage capacitor 5-1 is discharged and current modulator 2-1 becomes non-conductive. Then, switch 4-1 is reopened. The potential at circuit node 3 has become slightly positive. By closing switch 8 at time $t_{1b'}$, current modulator 10 is caused to adapt to this new situation: its current decreases to $I_{\Sigma}-I_{D1}$. This procedure of resetting OLED 1-1 enables the control block 12 to set the new luminosity D1' of this OLED in exactly the same way as described before referring to FIG. 2: At a time $t_{1c'}$, it causes current generator 11 to output $I_{DATA}=I_{D1'}$ and closes switch 4-1, so that current modulator 2-1 will draw precisely the current $I_{D1'}$ from circuit node 3 when the latter is at ground potential. Switch 4-2 is reopened, and at time $t_{1d'}$, current generator 11 blocks, and switch 8 is closed, so that the current $I_{10}$ supplied by modulator 10 increases to $I_{\Sigma}-I_{D1}+I_{D1'}$. The procedure is continued in a similar manner for all other OLEDs 1-2, . . . 1-n.

Since the control block 12 is used to program the luminosities of the OLEDs one by one, the resolution of the current generator 11 need not be higher than that of a single luminosity data received by the control block 12, regardless of the number of OLEDs in a column.

Referring to the teachings of EP 1 621 20 A1 it will be readily apparent to a skilled person that the operating procedure of the circuitry of FIG. 1 might be modified as follows: at first, the control block consecutively programs the luminosities of a small number of OLEDs, e. g. OLEDs 1-1, 1-2, as described in the cited document. At the end of this programming, the current $I_{DATA}$ output by current generator 11 amounts to $I_{D1}+I_{D2}$, if it is assumed that $I_{D1}$, $I_{D2}$ are the current intensities corresponding to the desired luminosities D1, D2 of OLEDs 1-1, 1-2. Then, control block 12 makes the current generator 11 non-conductive, as described above referring to FIG. 2 or 3, and closes switch 8, so that the current $I_{D1}+I_{D2}$ previously supplied by current generator 11 is "copied" to current modulator 10. It is readily apparent that the number of copying steps required for the build-up of a complete image is the smaller, the larger the number of OLEDs consecutively programmed between two copying steps is. On the other hand, the required resolution of the current generator 11 increases in proportion to the number of consecutively programmed OLEDs.

According to another embodiment, image build-up speed may be increased by not resetting the current modulators 2 prior to programming them. It is easily understood that when the display has just been activated and a first image is formed, the reset step is not necessary. When forming the second image, the luminosity of e. g. OLED 1-1 is programmed by having current generator 11 output a current $I_{DATA}=I_{D1'}-I_{D1}$, wherein $I_{D1'}$ is the current intensity corresponding to the desired luminosity D1' of OLED 1-1 in the second image. Since in this embodiment $I_{DATA}$ may be negative, the current generator 11 must be adapted to generate negative currents, e. g by means of a second transistor, not shown, connected in series between transistor 13 and V− and controlled by control block 12.

In this embodiment, any inaccuracy of $I_{DATA}$ may cause the luminosities of the OLEDs to drift. In order to limit such drifts, it is conceivable to apply a reset to each OLED when it has been reprogrammed without reset a predetermined number of times.

What is claimed, is:

1. A video display device comprising a matrix having rows and columns, each of said columns comprising:

a plurality of light emitting elements;

a plurality of first current modulators, each one of which being associated to one of said light emitting elements, the first current modulators being arranged to draw a feed current of programmable magnitude for the associated light emitting element, from a circuit node that is common to all of the plurality of first current modulators of said column, the luminosity of the light emitting element corresponding to the feed current;

a current generator, controlled by video data representative of desired luminosities of said light emitting elements, the current generator being arranged to controllably supply a first current to said common circuit node, the magnitude of which being representative of a desired luminosity of at least one of said light emitting elements connected to said common circuit node;

the common circuit node, in steady state, having a specific voltage level when the current supplied to the common circuit node equals the current drawn from the common circuit node by one or more of the plurality of first current modulators;

further comprising:

a second current modulator, the second current modulator being arranged to controllably supply a second current to said common circuit node;

a first comparator having inputs connected to said common circuit node and to a reference terminal, respectively, the reference terminal being constantly held at said specific voltage level, an output of said comparator being selectively connected to a control input of said second current modulator, for controlling the second current supplied to the common circuit node from said second current modulator so as to yield said specific voltage level at the common circuit node, wherein said specific voltage level is attained when the current provided by the second current modulator corresponds to the sum of the currents drawn by those first current modulators that already have been programmed to draw respective feed currents.

2. The display device of claim 1, wherein said comparator has its output connected to the control input of the second current modulator by a switch, and a storage capacitor is connected to the control input for maintaining it at a constant voltage when said switch is open.

3. The display device of claim 1, wherein the comparator is an operational amplifier having an inverting input connected to said circuit node and a non-inverting input connected to said reference terminal.

4. The display device of claim 1, further comprising a second comparator having inputs connected to said circuit node and to said reference terminal and a plurality of switches for selectively connecting an output of said second comparator to a control input of one of said plurality of first current modulators.

5. A method for operating a display device comprising a matrix having rows and columns, each of said columns comprising:

a plurality of light emitting elements arranged;

a plurality of first current modulators, each of which being associated to one of said light emitting elements, the current modulators being arranged to draw a feed current of programmable magnitude for the associated light emitting element, from a circuit node that is common to all of the plurality of first current modulators of said column, the luminosity of the light emitting element corresponding to the feed current;

a current generator, controlled by video data representative of desired luminosities of said light emitting elements, the current generator being arranged to controllably supply a first current to said common circuit node;

a second current modulator, the second current modulator being arranged to controllably supply a second current to said common circuit node;

the method comprising the steps of:

a) supplying a first current representative of a desired luminosity of one of said light emitting elements to said common circuit node from said current generator;

b) programming the first current modulator associated to said one of said light emitting elements to draw said first current from said common circuit node, whereby the circuit node attains a specific voltage level;

c) ceasing to supply said first current from said current generator;

d) controlling said second current modulator to supply a current that re-establishes said specific voltage level at said common circuit node.

6. The method of claim 5, wherein steps a) to d) are repeated for at least a second one of said light emitting elements and that while repeating steps a) and b) the magnitude of the second current is held at the value set in previous step d).

7. The method of claim 5, wherein steps a) to d) are repeated for said at least first one of said light emitting elements, and that before doing so, the first current modulator associated to said at least one of said light emitting elements is programmed not to draw current from said circuit node.

* * * * *